US008960445B2

(12) United States Patent
Malmberg

(10) Patent No.: US 8,960,445 B2
(45) Date of Patent: Feb. 24, 2015

(54) SUPPORT STRUCTURE HAVING FIXATION MEANS FOR SCREENING MEDIA

(75) Inventor: Mats Malmberg, Rydsgard (SE)

(73) Assignee: Sandvik Intellectual Property, Sandviken (SE)

( * ) Notice: Subject to any disclaimer, the term of this patent is extended or adjusted under 35 U.S.C. 154(b) by 0 days.

(21) Appl. No.: 14/006,122

(22) PCT Filed: Feb. 13, 2012

(86) PCT No.: PCT/EP2012/052401

§ 371 (c)(1),
(2), (4) Date: Sep. 19, 2013

(87) PCT Pub. No.: WO2012/130516

PCT Pub. Date: Oct. 4, 2012

(65) Prior Publication Data

US 2014/0008273 A1 Jan. 9, 2014

(30) Foreign Application Priority Data

Mar. 31, 2011 (EP) ..... 11160662

(51) Int. Cl.

| | |
|---|---|
| ***B07B 1/49*** | (2006.01) |
| ***B07B 1/00*** | (2006.01) |
| ***B07B 1/46*** | (2006.01) |

(52) U.S. Cl.
CPC .... *B07B 1/00* (2013.01); *B07B 1/46* (2013.01)
USPC ..... 209/399; 209/235; 209/405; 209/408; 209/644

(58) Field of Classification Search
USPC ..... 209/399, 405, 408, 644
See application file for complete search history.

(56) References Cited

U.S. PATENT DOCUMENTS

| | | | | |
|---|---|---|---|---|
| 2,740,525 | A * | 4/1956 | Wehner | 209/399 |
| 4,120,784 | A * | 10/1978 | Hassall | 209/399 |
| 2008/0257791 | A1 | 10/2008 | Malmberg | |

FOREIGN PATENT DOCUMENTS

| | | | |
|---|---|---|---|
| AU | 742060 | C | 11/2006 |
| DE | 3031057 | A1 | 2/1982 |
| DE | 20204123 | U1 | 5/2002 |
| WO | 8402290 | A1 | 6/1984 |
| WO | 2009078786 | A1 | 6/2009 |

* cited by examiner

*Primary Examiner* — Terrell Matthews
(74) *Attorney, Agent, or Firm* — Corinne R. Gorski

(57) ABSTRACT

A support structure for supporting screening media in a vibrating screen. The support structure is received on longitudinal beams of the vibrating screen. The support structure is formed of fixation strips having fixation parts, on which fixation parts carriers are received. The fixation strips and carriers are placed perpendicular to each other.

16 Claims, 5 Drawing Sheets

SUPPORT STRUCTURE HAVING FIXATION MEANS FOR SCREENING MEDIA

RELATED APPLICATION DATA

This application is a §371 National Stage Application of PCT International Application No. PCT/EP2012/052401 filed Feb. 13, 2012, claiming priority of EP Application No. 11160662, filed Mar. 21, 2011.

TECHNICAL FIELD

The present invention concerns a support structure to support screening media in a vibrating screen. The support structure has fixation means for the screening media.

PRIOR ART

In vibrating screens used for fractionation of for example crushed stones and gravel into fractions of stones with different sizes, screening media are used having screening holes for allowing stones smaller than the screening holes to pass through the holes.

Vibrating screens are known having a support structure, which support structure may carry different types of screening media. The support structure has often the form of a number of elements placed in a grid supporting the screening media. The screening media may have different forms, it could be a wire mesh, polymer mats, panels, screening mats or modular screening elements.

In one previously known embodiment the support structure is formed of support carriers and transversal carriers. The support carriers are placed in line with each other in several parallel lines of support carriers. Also the transversal carriers are placed in line with each other in several parallel lines of transversal carriers. The support carriers are placed on top of the transversal carriers and perpendicular to the transversal carriers. Loose spacer elements are placed on top of the transversal carriers between the support carriers. The spacer elements are to keep a proper distance between the lines of support carriers.

SUMMARY

In one aspect of the present invention a support structure and fixation means for screening media in a vibrating screen is provided. The vibrating screen is used for fractionizing of crushed stones, gravel etc. The support structure is formed of fixation strips and carriers placed perpendicular to each other.

According to the present invention the number of parts forming a support structure and fixation means for screening media in a vibrating screen is reduced. By having fewer parts the costs of manufacture, assembling and storing may be reduced.

Furthermore, the present invention makes it easy to mount the screening media to the support structure. This is partially achieved in that snap connections are used in several positions. By means of the snap connections it will be relatively easy to adapt the support structure to the screening media to be used. The screening media may be changed due to the material to be screened and the sizes of the desired fractions. By manufacturing the parts of the support structure in a polymeric material, or other materials of low weight such as fiberglass or aluminum, the weight of the support structure may be kept relatively low. The relatively few parts of the support structure do also contribute to the relatively low weight of the support structure. The different parts of the support structure are easy to replace and easy to adapt to different screens. The use of snap connections obviates the use of screws, welding or other fixation means.

Further objects and advantages of the present invention will be obvious to a person skilled in the art, when reading the detailed description below of embodiments of the present invention.

BRIEF DESCRIPTION OF THE DRAWINGS

The invention will be described further below by way of an example and with reference to the enclosed drawings. In the drawings.

DETAILED DESCRIPTION OF EMBODIMENTS

The expressions "lower", "upper" and similar expressions are in view of the Figs. referred to and with the normal orientation of a vibrating screen.

Figure 1:
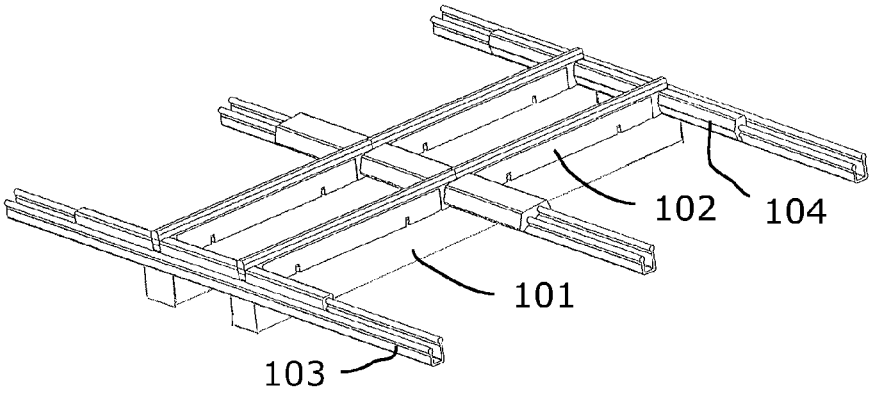
FIG. 1 is a perspective view of a previously known support structure for screening media in a vibrating screen.
Figure 2:
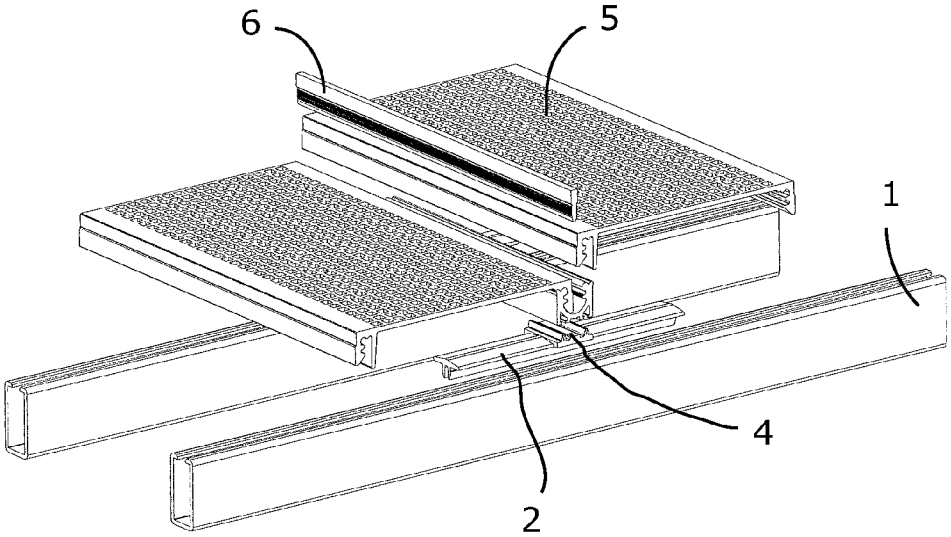
FIG. 2 is a perspective, exploded view of a support structure for screening media according to the present invention, also indicating mounting of screening media to the support structure.
Figure 3:
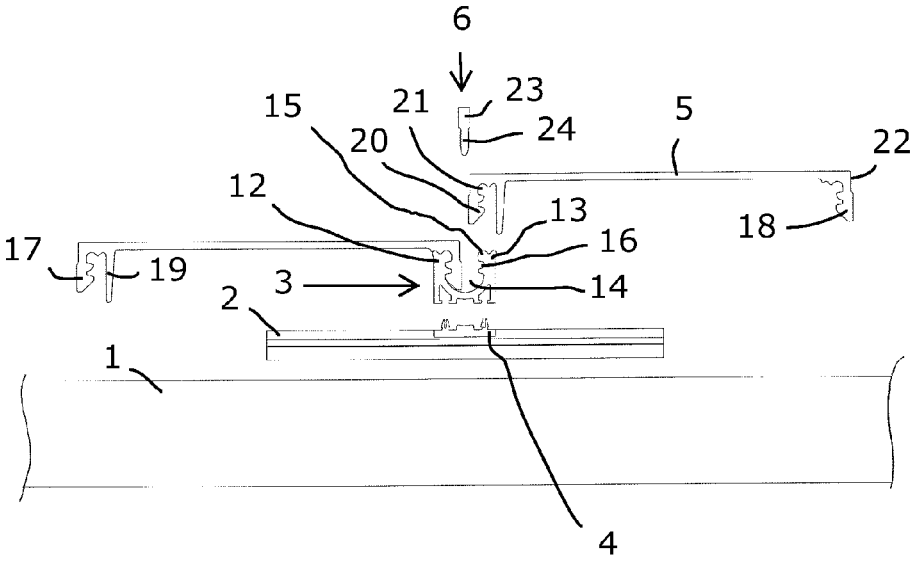
FIG. 3 is a side view, partially exploded, of the support structure of FIG. 2.
Figure 4:
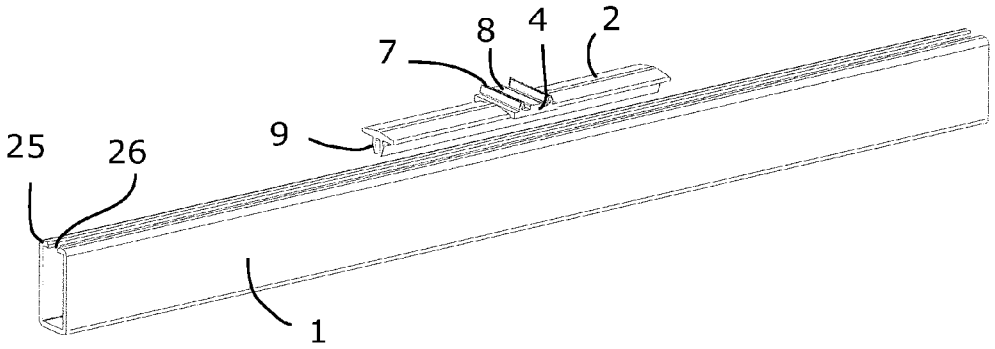
FIG. 4 is a perspective view of a part of the support structure of FIGS. 2 and 3.

In vibrating screens the screening media is normally placed on a supporting structure. One example of such a support structure is shown in FIG. 1. The known support structure of FIG. 1 is received on longitudinal beams 101 of the vibrating screen. The longitudinal beams 1 are fixed to a framework of the vibrating screen in a known way. On the longitudinal beams a grid of support carriers 102 and transversal carriers 103 is fixed. A number of support carriers 102 are placed parallel to each other and at a distance to each other. Thus, a number of rows of support carriers 102 are formed and in each row a number of support carriers are placed in line. Also the transversal carriers 103 are placed parallel to each other and at a distance from each other. The transversal carriers 103 are placed perpendicular to the support carriers 102. Each support carrier 102 is received on two adjacent transversal carriers 103, in that one end of each support carrier 102 is received on a transversal carrier 103. Spacer elements 104 are placed on the transversal carriers 103 between two support carriers 102. The spacer elements 104 are to keep a proper distance between the support carriers 102. Screening media is to be placed on top of the support carriers 102 of the support structure.

In the embodiments shown in FIGS. 2-9 the number of parts in the support structure of the present invention is reduced compared to the number of parts of the known support structure.

In a first embodiment of the present invention, shown in FIGS. 2-6, fixation strips 2 are received on longitudinal beams 1. The fixation strips 2 normally extend all of the length of the longitudinal beams 1, even though they are shown as shorter here. The longitudinal beams 1, corresponding with the longitudinal beams 101 of the embodiment of FIG. 1, are fixed to a framework of the vibrating screen, for instance by welding. As the fixation of the beams 1 to the framework of the vibrating screen does not form part of the present invention it will not be discussed further here.

Carriers 3 are received on fixation parts 4 on top of the fixation strips 2. Screening media, here in the form of screening mats 5 are received in the carriers 3 and the screening mats 5 are kept in place in the carriers 3 by means of wedge elements 6.

Compared to the above described previously known support structure, the support structure of the present invention has no parts corresponding with the spacer elements 104 and the support carriers 102 have been replaced with the fixation strips 2.

Figure 5:
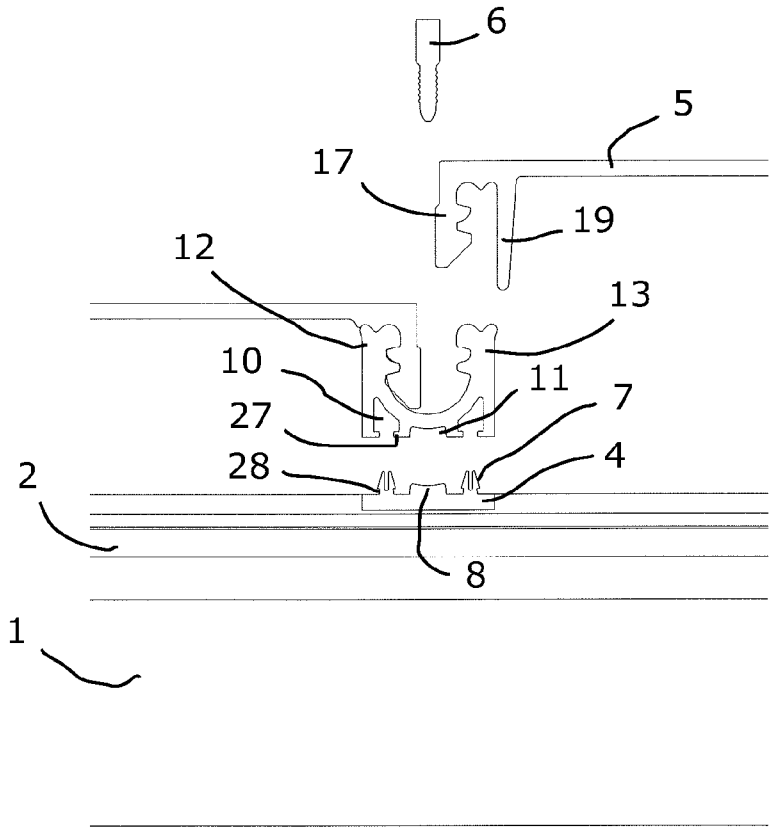
FIG. 5 is an enlarged partially exploded view illustrating cooperating parts in assembly of the support structure and the screening media.
Figure 6:
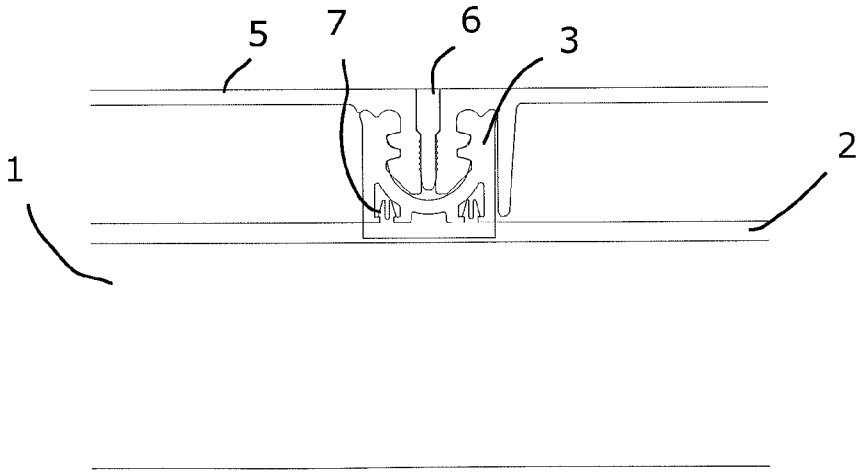
FIG. 6 is a view corresponding to FIG. 5 after assembly.

In the present invention, as shown in the embodiment of FIGS. 2-6, a number of beams 1 are placed parallel to each other and at a distance from each other. The beams 1 are hollow and have a rectangular form as seen in cross section. In the upper part 25 of each beam a longitudinal opening 26 is formed in the centre. Each fixation strip 2 has a longitudinal snap rail 9, projecting downwards from the fixation strip 2. The fixation strips 2 have a generally elongated upper part of plate shape and are placed covering the upper side of the beams 1. The snap rails 9 have the form of two elastic parallel strips placed at a distance from each other. On the outside of each strip a groove is formed, in said grooves of the snap rails 9 of the fixation strips 2 edges of the longitudinal openings 26 of the beams 1 are to be received when the fixation strips 2 are snapped into place on top of the beams 1, in that the snap rails 9 are pushed down into the longitudinal openings 26 of the beams 1. This snapping action between the fixation strips 2 and the beams 1 corresponds with the snapping action between the fixation parts 4 and the carriers described below, and as indicated in FIGS. 5 and 6. As stated above the fixation strips 2 extend all of the length of the longitudinal beams. The fixation strips 2 are often made in one piece, but in some cases two or more fixation strips 2 are placed after one and other along the longitudinal beams 1.

The carriers 3 are placed perpendicularly to the beams 1 and parallel with each other. The carriers 3 are placed at a distance from each other, which distance is adapted to the size of separate parts of the screening mats 5 to be received. As indicated above the carriers 3 are fixed to fixation parts 4 on top of the fixation strips 2. The fixation parts 4 are placed in the middle of the fixation strips 2 and the fixation parts 4 have a width corresponding to the width of the carriers 3 to be received. The fixation parts 4 are formed in one piece with the fixation strips 2. Thus, the distance between the fixation parts 4 on one fixation strip 2 is fixed. On the top of each fixation part 4 there are two parallel snap rails 7, placed at a distance from each other. Each snap rail 7 has the form of two elastic parallel strips placed at a distance from each other. Between the parallel snap rails 7 there is a raised section 8. The snap rails 7 and the raised section 8 extend all the length of each fixation part 4. The snap rails 7 and the raised section 8 are to co-operate with complimentary parts of the carriers 3, in order to fix the carriers 3 to the fixation strips 2. Even though each fixation part 4 is shown having two snap rails 7, a person skilled in the art realizes that the fixation part may have any suitable number of snap rails.

On a lower side of each carrier 3 there are two longitudinal recesses 10 and a longitudinal channel 11, with the longitudinal channel 11 placed in the middle between the two longitudinal recesses 10. Said longitudinal recesses 10 and longitudinal channel 11 are to co-operate with the snap rails 7 and raised section 8, respectively, of the fixation part 4, in order to snap each carrier 3 to fixation strips 2. At the bottom of each longitudinal recess 10 of each carrier 3 two longitudinal edges 27 are formed perpendicularly to the side of the carrier 3. The edges 27 are facing each other and are arranged to leave a gap between the ends of the edges 27. In said gap between the edges 27 of each recess 10 a snap rail 7 of the fixation part 4 is to be received. The snap rails 7 have longitudinal grooves 28 on opposing sides, in which grooves 28 the edges 27 of the recesses 10 of the carriers 3 are to be received. The raised sections 8 of the fixation parts 4 are received in the longitudinal channels 11 of the carriers. The number of recesses is to correspond with the number of co-operating snap rails of the fixation strip.

Normally, each carrier 3 extends the total width of the vibrating screen and is fixed to each fixation strips 2. In some cases two or more carriers 3 placed after one and other spans the width of the vibrating screen. Each carrier 3 has two sides 12, 13 projecting upwards, between which sides a slot 14 is formed. On the parts facing each other the sides 12, 13 have a number of protrusions 15 and grooves 16. The protrusions 15 and grooves 16 are to co-operate with complimentary parts of the screening mat 5.

Each screening mat 5 has end parts 17, 18 at opposite edges, which end parts projects downwards. At a distance from one end part 17 a protection 19 projects downwards. The distance between the protection 19 and adjacent end part 17 is adapted to snugly receive one side 13 of the carrier 3. Each end part 17, 18 has a number of protrusions 20 and grooves 21 for co-operation with the protrusions 15 and grooves 16 of the sides 12, 13 of a carrier 3. In each carrier 3 one end part 17, 18 of two adjacent screening mats 5 are received. When respective end part 17, 18 of the two adjacent screening mats 5 are received in the protrusions 15 and grooves 16 of the sides 12, 13 of the carrier 3, there is a small distance between the end parts 17, 18. In the space formed between the end parts 17, 18 the wedge element 6 is inserted. A lower part 24 of the wedge element 6 is thinner than an upper part 23. The lower part 24 of the wedge element 6 is pointed to facilitate insertion. Furthermore, an upper part 22 of the outer side of each end part 17, 18 of each screening mat is recessed to facilitate insertion of the wedge element 6. The lower part 24 of the wedge element 6 may have a number of longitudinal crests to increase the friction between the wedge element 6 and the end parts 17, 18 of the screening mats 5.

One example of carriers and screening media having co-operating protrusions and grooves is shown in the applicant's Swedish patent applications No. 1050201-1 and No. 1050199-7. Reference is made to these applications for a more extended description of the cooperation between the carriers 3 and the screening mats 5.

The screening mats 5 are placed transversally to the direction of travel for the material on the vibrating screen.

Figure 7:
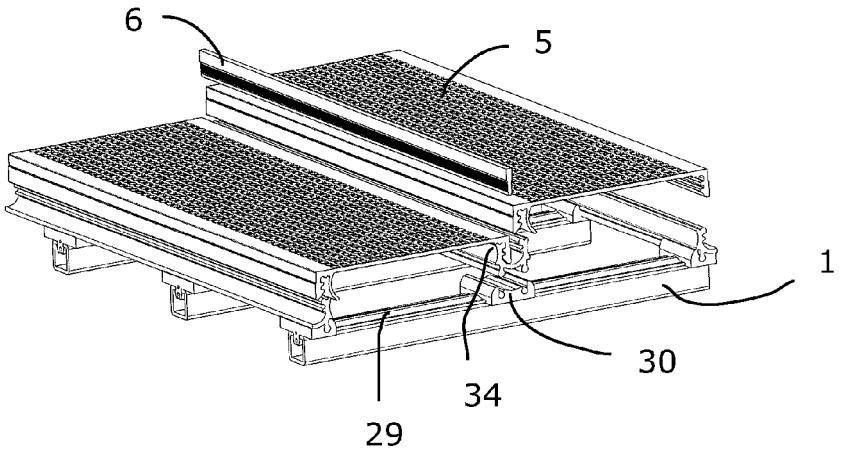
FIG. 7 is a view corresponding with FIG. 2 of a second embodiment.
Figure 8:
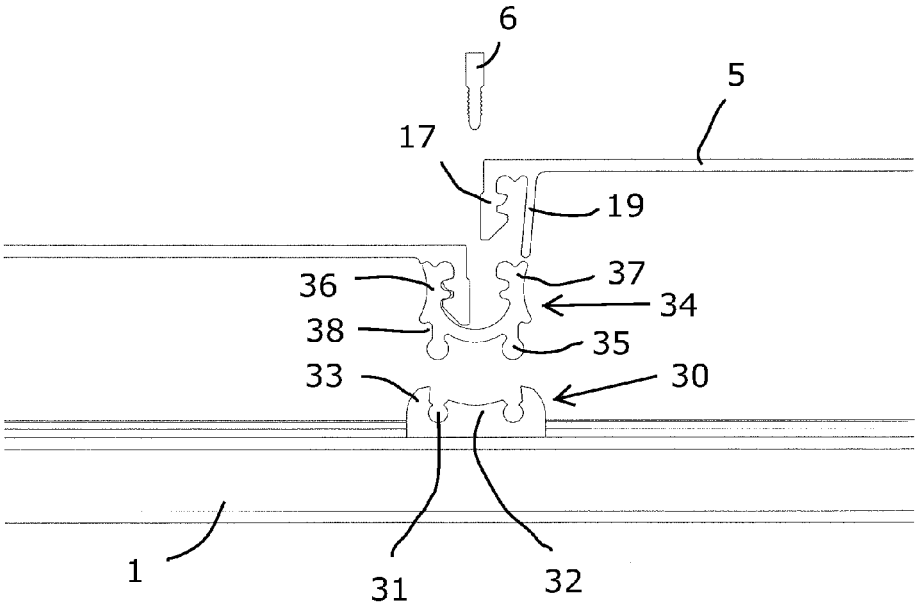
FIG. 8 is an enlarged partially exploded view illustrating cooperating parts in assembly of the support structure and the screening media of the second embodiment of FIG. 7.
Figure 9:
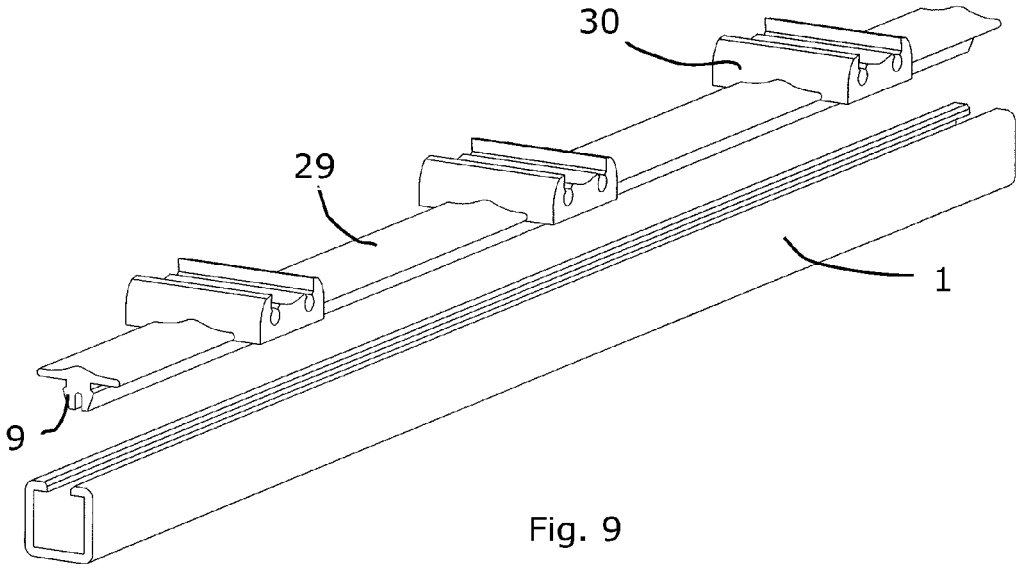
FIG. 9 is a perspective view of co-operating parts of the second embodiment of FIGS. 7 and 8.

The embodiment of FIGS. 7, 8 and 9 differs from the embodiment described above mainly in the design of fixation parts 30 on fixation strips 29 and co-operating carriers 34. The description here will therefore be concentrated on the parts differing from the previously described embodiment.

Also in this embodiment fixation strips 29 are received on longitudinal beams 1. As stated for the embodiment described above, the fixation strips 29 are received on the beams 1 in that the snap rails 9 snaps in to the longitudinal opening 26 of each beam 1. Carriers 34 are received on fixation parts 30 of the fixation strips 29. Screening mats 5 are received in the carriers 34 and the screening mats 5 are kept in place in the carriers 34 by means of wedge elements 6. As indicated in FIG. 9 a number of fixation parts 30 are placed at a fixed distance from each other on the fixation strip 29. The distance between the fixation parts 30 are adapted to the size of the screening media 5 to be received. As indicated above the fixation strips 29 normally extend the total length of the beams 1.

Each fixation part 30 has two grooves 31 placed on opposite sides of a middle section 32, as seen in cross section, which middle section 32 is placed in the centre of the fixation part. A side part 33 outside each groove 31, projects above the middle section 32. The grooves 31, middle section 32 and sides 33 are to co-operate with complimentary parts of the carriers 34, in order to fix the carriers 34 to the fixation parts 30 of the fixation strips 29. On the lower side of each carrier 34 there are two rails 35 projecting downwards. The rails 35 of the carriers 34 are to be received in the grooves 31 of the fixation parts 30. The middle section 32 of each fixation part 30 is to be placed between the rails 35 of the carrier 34. The carriers 34 have a recess 38 outside each rail 35. The sides 33 of the fixation part 30 are to abut the recesses 38. Even though the rails 35 of the carriers 34 and the grooves 31 of the fixation parts 30 are shown having circular cross section forms, a person skilled in the art realizes that the rails 35 and grooves 31 may have many different cross section forms.

Each carrier 34 has two sides 36, 37 projecting upwards, between which sides a slot is formed. The sides 36, 37 have a number of protrusion and grooves facing each other. In the slot, end parts 17, 18 of two screening mats 5 are to be received, in the same way as for the previously described embodiment. Thus, the end parts 17, 18 of the screening mats 5 are held in the slot of each carrier 34 by the co-operation between the protrusion and grooves of the sides 36, 37 of the carrier 34 and the protrusions and grooves of the end parts 17, 18 of the screening mats 5, respectively, and by the wedge element 6. The number of grooves of each fixation part and the number of rails of each carrier are the same, and may be any suitable number.

A person skilled in the art realizes that the exact form of the parts forming the different connections may vary. Thus, the snap rails 9, 7 of the fixation strips 2, 29 and fixation parts 4, respectively, may have any other suitable form enabling the fixation strips 2, 29 to be snapped to the beams 1 and the carriers 3 to be snapped to the fixation parts 4 of the fastening strips 2, respectively.

Furthermore, a person skilled in the art realizes that the fixation strips 2, 29 and the carriers 3, 34 may be manufactured in any suitable material. Preferably materials having low weight and high strength are used, such as polymeric material, aluminum, plastic, glass fiber reinforced plastics.

The invention claimed is:

1. A support structure and fixation means for screening media in a vibrating screen for fractionizing of crushed stones, gravel or the like, the support structure and fixation means comprising:

a plurality of fixation strips; and a plurality of carriers, the plurality of fixation strips and plurality of carriers being placed perpendicular to each other, wherein each fixation strip has a generally elongated upper part having a plate shape and a downwardly projecting snap rail, and wherein each fixation strip is received on top of a beam, the beam being placed longitudinally in the vibrating screen and fixed to a frame of the vibrating screen.

2. The support structure of claim 1, wherein a plurality of beams are placed parallel and evenly spaced in the vibrating screen, wherein each of the beams has a longitudinal opening in an upper part, in which the longitudinal opening and the snap rail of each of the fixation strips are received and wherein edges of the longitudinal opening of each of the plurality of beams snap into grooves on the outside of the snap rail of the fixation strips.

3. The support structure of claim 1, wherein a fixation part is placed on top of each fixation strip.

4. The support structure of claim 3, wherein the fixation part has one or more snap rails, the one or more snap rails extending perpendicular to a general direction of the respective fixation strip on which the fixation part is placed.

5. The support structure of claim 4, wherein the fixation part has two snap rails and a raised section disposed between the one or more snap rails.

6. The support structure of claim 4, wherein each of the plurality of carriers has one or more longitudinal recesses on a lower side thereof for receiving the one or more snap rails of the fixation part of each of the fixation strips.

7. The support structure of claim 3, wherein each fixation part has one or more grooves, the one or more grooves being directed perpendicular to a general direction of the respective fixation strip on which the fixation part is placed.

8. The support structure of claim 7, wherein each of the plurality of carriers has one or more longitudinal rails on a lower side thereof that are received by the one or more grooves of the fixation part of the respective fixation strip, and wherein each of the plurality of carriers has a longitudinal channel for receiving the raised section of the fixation part.

9. The support structure of claim 7, wherein each of the plurality of carriers has two sides projecting upwards and between which sides a slot is formed and wherein the sides have a number of protrusions and grooves on the inner sides of the slot, in which slot an end part of two adjacent screening media is to be received and wherein each end part of the screening media has protrusions and grooves for cooperation with the protru-sions and grooves of the carriers.

10. The support structure of claim 9, wherein a longitudinal wedge element is received between the end parts of the two adjacent screening media placed in the slot of each carrier, wherein the wedge element has an upper part and a lower part, which lower part is thinner than the upper part, wherein the lower part of the wedge element is pointed and wherein the upper part of each end part of each screening media has an outer upper part forming a recess, which recess is to receive the upper part of the wedge element.

11. The support structure of claim 1, wherein the screening media is a plurality of screening mats.

12. The support structure of claim 3, wherein a fixation part is placed in a middle of a respective fixation strip.

13. The support structure of claim 3, wherein the fixation part has a width corresponding with the width of a respective carrier.

14. The support structure of claim 3, wherein each fixation part is an integrated part of each fixation strip.

15. The support structure of claim 6, wherein the one or more recesses have longitudinal edges snapping into grooves on the outside of the snap rails of the fixation parts.

16. The support structure of claim 6, wherein each carrier has a longitudinal channel for receiving the raised section of the fixation parts of the fixation strips.

* * * * *